United States Patent [19]

Hirata

[11] Patent Number: 4,459,449

[45] Date of Patent: Jul. 10, 1984

[54] COOKING APPARATUS WITH MENU DISPLAY

[75] Inventor: Hidetoshi Hirata, Fuji, Japan

[73] Assignee: Tokyo Shibaura Denki Kabushiki Kaisha, Kawasaki, Japan

[21] Appl. No.: 343,317

[22] Filed: Jan. 27, 1982

[30] Foreign Application Priority Data

Jan. 29, 1981 [JP] Japan ..... 56-12114

[51] Int. Cl.[3] ..... H05B 6/68

[52] U.S. Cl. ..... 219/10.55 B; 219/10.55 R; 219/506; 99/325; 340/713; 340/809; 116/294; 116/311

[58] Field of Search ..... 219/10.55 B, 10.55 R, 219/10.55 E, 489, 506; 318/685; 340/713, 806, 808, 809; 116/284, 307, 294, 309, 305, 311; 99/325, 327, 451, DIG. 14; 235/435, 375

[56] References Cited

U.S. PATENT DOCUMENTS

| | | | |
|---|---|---|---|
| 3,946,298 | 3/1976 | Van de Loo | 318/685 |
| 3,978,306 | 8/1976 | Mori | 219/10.55 B |
| 4,110,674 | 8/1978 | Enomoto | 318/685 X |
| 4,254,370 | 3/1981 | Miller | 318/685 |
| 4,297,568 | 10/1981 | Okatsuka | 219/506 X |

FOREIGN PATENT DOCUMENTS

| | | | |
|---|---|---|---|
| 52-50448 | 11/1977 | Japan . | |
| 54-111148 | 8/1979 | Japan | 219/10.55 B |
| 55-146335 | 11/1980 | Japan | 219/10.55 B |
| 55-146336 | 11/1980 | Japan | 219/10.55 B |

*Primary Examiner*—B. A. Reynolds
*Assistant Examiner*—Philip H. Leung
*Attorney, Agent, or Firm*—Schwartz, Jeffery, Schwaab, Mack, Blumenthal & Koch

[57] ABSTRACT

Disclosed is a cooking apparatus having operating keys for selecting a cooking menu, a display device having a number of display cards each inscribed with a cooking menu, and a rotatable member having the display cards swingingly secured along its periphery. The display cards are successively turned to successively change the displayed menu according to the rotation of the rotatable member. The cooking apparatus further has drive means for rotating the rotatable member, control means for controlling the drive means to rotate to the position determined by the signal from the operating keys. The apparatus further comprises heating device for heating items to be cooked, and means for operating the heating device according to a sequence corresponding to the cooking menu displayed on the displaying device by the signal from the operating keys.

21 Claims, 6 Drawing Figures

COOKING APPARATUS WITH MENU DISPLAY

BACKGROUND OF THE INVENTION

1. Technical Field of the Disclosure

The present invention relates to a cooking apparatus, and more particularly to a microwave cooking apparatus having a device for displaying various cooking menus.

2. Description Of The Prior Art

In an ordinary cooking apparatus such as a microwave oven, various menus, depending upon the nature and quantity of the food to be cooked as well as the cooking conditions, are printed in the vicinity of operating keys on a front panel of the apparatus or on a display drum provided in the apparatus. In addition, the cooking conditions, such as cooking time and cooking temperature, are set in the apparatus by the operator, who selects a cooking program based upon the observed menu. For example, a cooking apparatus employing the present invention may have both the functions of microwave heating and electric heating for grilling or browning. Therefore, the food may be cooked by various heating modes comprising some combination of microwave heating and/or electric heating.

As compact microwave cooking ovens become more versatile with expanded potential for choosing cooking modes and greater numbers of menus for cooking more kinds of foods, a problem arises in displaying the various cooking modes and menus due to the limited display and control panel area. Therefore, the menu display function of the cooking apparatus cannot be accomplished satisfactorily. In order to increase the number of cooking menus capable of being displayed on an oven panel, a display device having many display cards, swingably secured to a peripheral part of a rotary drum (the so-called leaf type display device), has now been developed. However, no apparatus now exists which combines both the display of a menu with the automatic setting of the cooking or heating modes according to the desired combinations of microwave heating, electric heating, cooking time and cooking temperature while the operator observes the menu displayed on the display and control panel thus obviating a heretofore disadvantage of operator difficulty and confusion.

In some prior art cooking devices, magnetic cards or so-called computer cards are prepared containing information regarding cooking conditions, cooking mode, cooking time and cooking temperature for various foods. The desired cooking program may be set by inserting a suitable card in the cooking apparatus. Inserting the card into the cooking apparatus "programs" the heating apparatus to carry out an automatic cooking sequence including, for instance, a preheating step which may use an electric heater, a predetermined microwave heating step and predetermined electric heating step under the control of a programmed processor in the cooking apparatus.

However, with such a device the number of cards increases directly as the number of cooking menus desired. This results in the difficult problem of ordering, selecting and maintaining these cards.

In some recent cooking devices, various sensors and microcomputers are combined for executing various cooking menus automatically. However, with this type of cooking apparatus, the operator of the apparatus is not appraised regarding cooking conditions such as temperature and time. This results in anxiety about the cooking program and menu being executed by the oven.

SUMMARY OF THE INVENTION

Therefore, it is an object of the present invention to provide a novel cooking apparatus having a menu display device.

It is another object of the invention to provide a novel cooking apparatus having many cooking menus displayable in the cooking apparatus for facilitating the selection of desired menus.

It is a further object of the invention to provide a novel cooking apparatus wherein the cooking conditions are set coincident with the display of the contents of a menu automatically.

It is a still further object of the invention to provide a novel cooking apparatus wherein a desired cooking menu may be selected by an indexed display corresponding to various heating modes.

To accomplish the foregoing and other objects in accordance with a preferred embodiment of the present invention, there is provided a cooking apparatus having a control panel with control keys or the like for selecting a cooking menu, a display device having a number of display cards each describing a cooking menu and a rotatable member having the display cards swingably secured along a peripheral portion thereof, the display cards being successively turned over to successively change the menu displayed according to the rotation position of the rotatable member, drive means for rotating the rotatable member, a control means for controlling the drive means to rotate the rotatable member to a position determined by a signal from the control panel, heating device for heating the food to be cooked, means for operating the heating device according to a sequence corresponding to the selected cooking menu displayed on the display device in accordance with the signal from the control keys.

Other objects, features and attendant advantages of the invention will become readily apparent as the apparatus becomes better understood by reference to the following detailed description of a preferred embodiment, when considered in connection with the accompanying drawings.

BRIEF DESCRIPTION OF THE DRAWINGS

In the drawings, forming a part hereof, in which like reference characters denote like parts in the various views.

DETAILED DESCRIPTION OF PREFERRED EMBODIMENTS

What follows is a description of a preferred embodiment of the invention.

Figure 1:
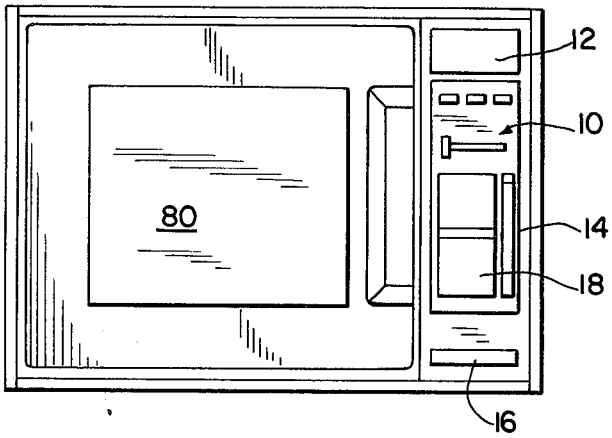
FIG. 1 is a perspective view showing the appearance of a cooking apparatus according to the preferred embodiment of the invention.
Figure 2:
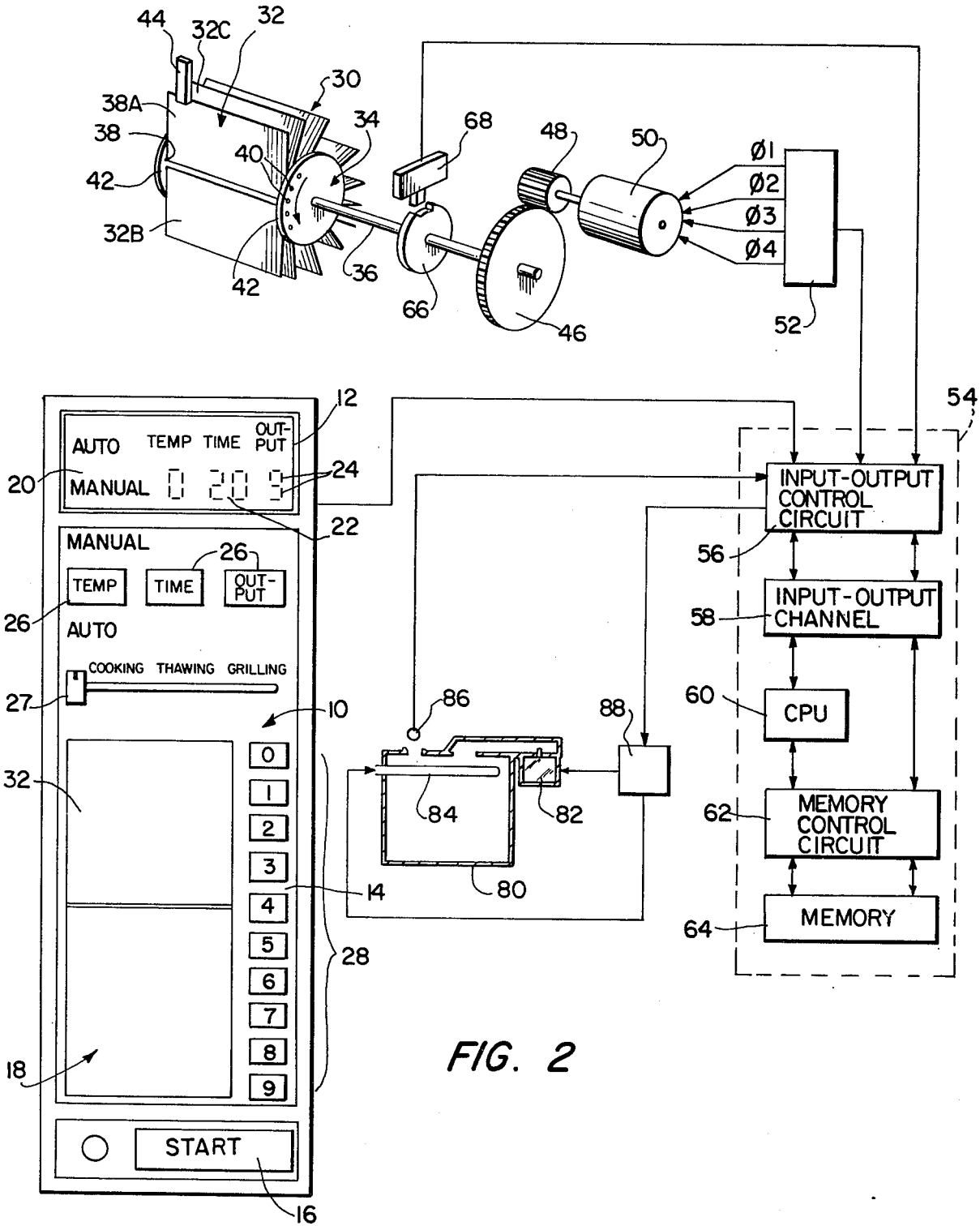
FIG. 2 is a diagram illustrating the general construction of the menu display and includes a block diagram of the interconnection of the various elements to a microcomputer.

In FIGS. 1 and 2, reference numeral 10 designates a control panel or operating board on the front panel of the cooking apparatus on which a digital display board 12, an operating key board 14, a start button 16 and a cooking menu display window 18 are provided. The digital display board 12 has an auto/manual display 20 which indicates whether the manual or automatic mode has been selected and if automatic indicates how the cooking operation is progressing. The display board 12 further includes a digital display 22 having digital display elements 24 which indicate cooking temperature, cooking time and cooking output or power, respectively.

The control panel 14 is provided with manual selecting keys, or the like, 26 which may be used to select the desired temperature, time or output during manual operation. There is also provided a slide switch, or the like, 27 for selecting the desired heating mode or cooking function such as "cooking", "thawing", "grilling", or "browning" for suitable automatic cooking processes according to the foods to be cooked. The control panel 14 is further provided with keys, or the like, 28, preferably 10 keys numbered 0 to 9, to input various numbers for selecting the temperature, time, power, or for selecting the below described menu display device. A start button 16 is used for starting a cooking process and for changing from one cooking operation to the next. Behind the cooking menu display window 18, there is provided a so-called leaf type cooking menu display device 30 which is capable of displaying a great number of cooking menus selectively one at a time.

Figure 3A:
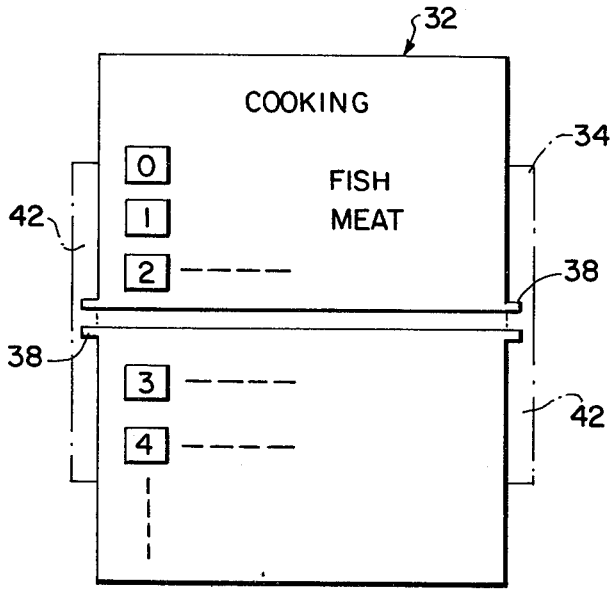
FIGS. 3A and 3B are enlarged front views depicting examples of exemplary cooking displaying or menu cards.
Figure 3B:
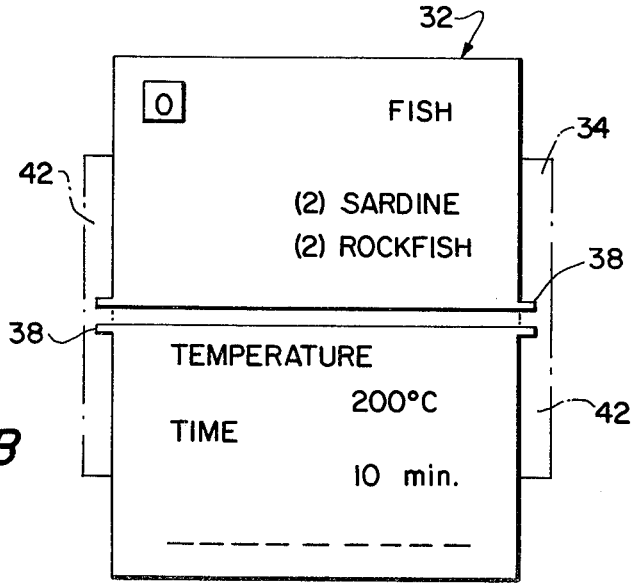

In detail, the cooking menu display device 30 comprises a number of displaying cards or leaves 32, each inscribed with the contents of a particular cooking menu. The display cards 32 are swingably secured to the peripheral portion of a rotatable member 34 mounted on a rotary shaft 36. For example, each card 32 may be made of plastic plate and may have an integral pair of detents or "ears" 38 extending horizontally along one edge as best seen in FIGS. 3A and 3B. These detents function as an axle and are pivotingly secured in bearing holes 40 provided along the peripheral edge of side walls 42 of the rotatable member 34 as shown in FIG. 2. When the rotatable member 34 is rotated in the direction of the arrow A, the displaying cards 32 are successively turned over, and the successive cooking menus are thereby displayed in the display window 18. A total menu may consist of an upper card 32A and a lower card 32B. (see FIGS. 3A and 3B)

Turning back to FIG. 2, reference numeral 44 designates a stopper which may resiliently restrict unrestrained swinging movement of the displaying cards by holding the upper card 32A in its proper display position. When being displayed, the card 32A should be positioned at the forefront of upper side of the rotatable member 34. Stop member 44 restricts the tendency of card 32A to swing counterclockwise. However, by progressing the rotation of the rotatable member 34, the upper edge of the display card 32A passes through the resilient stopper 44 thereby turning it over to assume the position previously occupied by card 32B. In that position, the display card 32A will show its "rear" side as a lower part of the next cooking menu being displayed. At that time, the next card 32C will be positioned at the forefront as the upper part of the cooking menu displayed through the display window 18 and its movement will be restricted by the stopper 44.

FIGS. 3A and 3B show examples of two possible display cards 32 which can be used with the so-called leaf type cooking menu display device 30. A first type of display cards 32 is shown in FIG. 3A and is a cooking function display which consists of a pair of cards which show the heating mode, i.e. cooking, thawing, etc., along with an indexed form of various items which may be treated such as fish and meat, along with index numbers corresponding to the numbers of the keys 28 to be operated for heating these items as classified by the desired heating function, such as "cooking", "thawing", "grilling" or "browning".

A second type of display by cards 32 is shown in FIG. 3B. This consists of a pair of cards 32 displaying an individual cooking menu and indicating the items to be cooked as well as the cooking conditions such as heating temperature and heating time under which the item should be cooked. The cooking conditions are provided for the operator's information since, as described below, the menu is processed automatically.

The heating function on the display cards 32, for example that of "cooking", is followed according to a predetermined program for each of the individual cooking menu display cards which are arranged in order, and correspond to the numbers of the keys 28 to be operated for "cooking". The cards are ordered in a reverse direction relative to the arrow A for those cards which call for a "cooking" mode. Following these "cooking" heating mode cards, other heating mode display cards, for example, the group of "grilling" cards, are positioned. These cards are similarly ordered in a reverse direction relative to the arrow A in a sequence corresponding to the numbers of the keys 28 to be operated for "grilling".

Turning again to FIG. 2, it may be seen that the rotatable member 34 is driven by the shaft 36 which in turn is driven through gears 46 and 48 by a motor 50 of the step motor type. At the input side of the step motor 50, there is provided a step motor driving circuit 52 which is controlled by a microcomputer and which applies drive pulses to the step motor 50. The microcomputer 54 can be a general purpose microcomputer, such as that disclosed in U.S. Pat. No. 4,177,369 and U.S. Pat. No. 4,230,731 having an input-output control circuit 56, an input-output channel 58, a central processing unit 60, a memory control circuit 62, and a memory device 64.

The central processing unit 60 of the microcomputer performs memory functions, programming functions, sequencing control functions and contains a master oscillator clock. The input-output control circuit 56 of the microcomputer 54 has the display input and output section which supplies data from the central processing unit 60 to a decoder and display panel driver as shown in U.S. Pat. No. 4,177,369. The output of the driver energizes the digital display elements 24 of the digital display board 12. Input data from the keys 26, 27 and 28 or the start button 16 encode the input-output control circuit 56 as shown in U.S. Pat. No. 4,177,369 and U.S. Pat. No. 4,230,731.

A timing cam 66 or similar timing device is mounted on the gear shaft 36, and a timing signal generator such as switch 68 associated with the timing device 66 is connected to the input-output control circuit 56. The timing signal generator detects a reference position of the timing device 66 or similar member to control the step motor 50.

Figure 4:
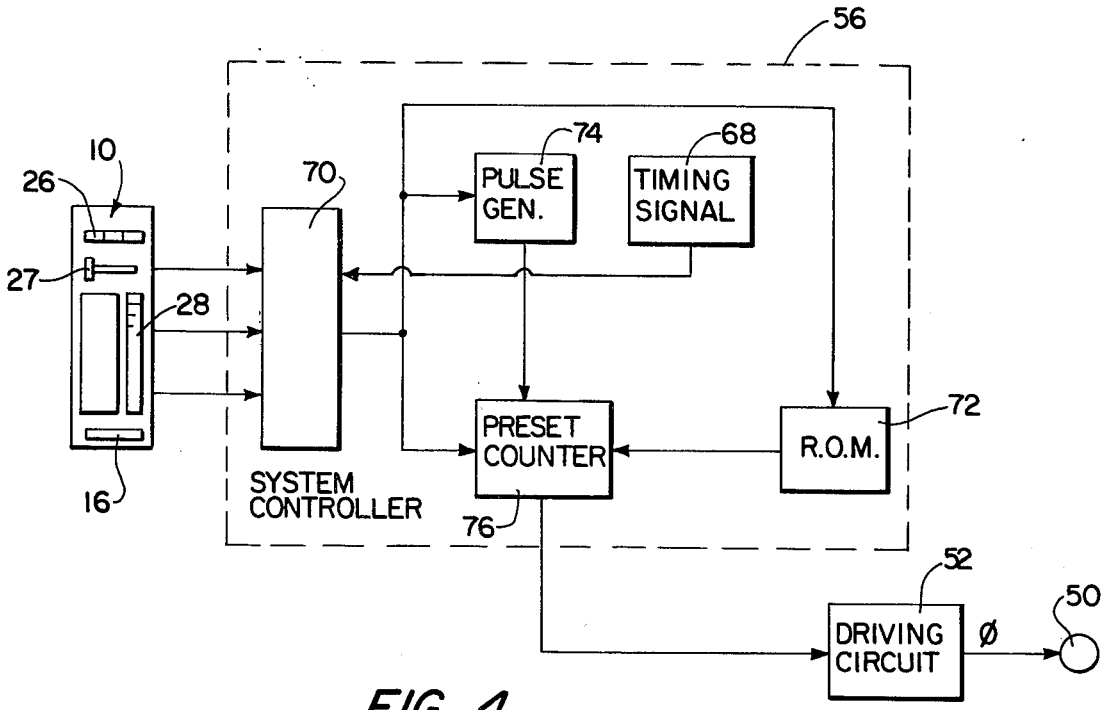
FIG. 4 is a block diagram of a circuit for driving a step motor according to a preferred embodiment of the invention.

The control operation of the step motor 50 will now be described in detail with respect to FIG. 4. The manual selecting keys 26, the keys 28 and the start button 16 of the control panel 10 are connected to system controller 70 in the input-output control circuit 56. The system controller 70 is connected to a ROM 72 programmed in accordance with the number of pulses determined either automatically from the menu selected or manually from keys 28, pulse generator 74 which is connected to the master oscillator clock included in system controller 70 and preset counter circuit 76. The timing signal generator 68 is connected to the system controller 70 to give a starting signal for starting the pulse count. The preset counter circuit 76 is connected to the step motor driving circuit 52 as further described below.

The step motor 50 is driven as follows:

When the operator pushes or shifts the keys 26, 27 or 28 according to the desired program, that is, the desired cooking function or the desired cooking menu and operates the start button 16, the signals from the selector 27 or keys 26 and 28 are processed through the system controller 70 and the preset counter circuit 76 to set the number of pulses programmed by the ROM 72. The preset counter circuit 76 starts to count the pulses from the pulse generator 74 to drive the step motor 50 according to the number of pulses generated. The step motor is driven through the step motor driving circuit 52. The step motor 50 rotates until the pulses from the preset counter circuit 76 to the driving circuit 52 terminate, that is, until the number of the pulses from ROM 72 and from the pulse generator 74 after the signal from the timing signal generator 68 arrives are coincident.

The step motor 50 rotates through a range corresponding to the positions of the display cards, so that desired cards 32 may be positioned at the cooking menu display window 18.

Figure 5:
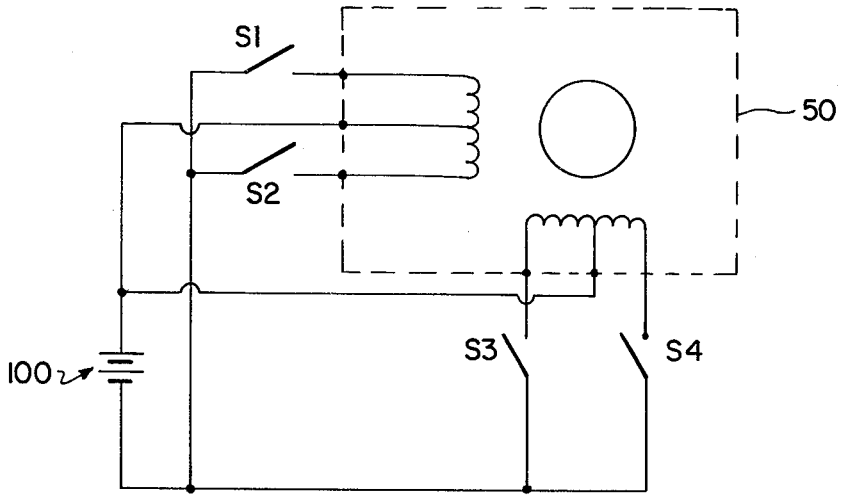
FIG. 5 is a schematic representation of a step motor and driving circuit useful with the display device of the present invention.

As best understood from FIGS. 2 and 5, the step motor 50 is driven by the driving circuit 52 which includes switches S1, S2, S3 and S4, corresponding respectively to signals 1, 2, 3 and 4 of FIG. 2.

Signal will activate switch S1 thus causing step motor 50 to rotate through a predetermined range. Upon the energization of switch S2 by signal 2, the step motor 50 will be further actuated to rotate through an additional range corresponding to the geometry of the stator and armature windings. This progressive movement is repeated depending upon the signals received from the drive circuit 52.

It should be understood that the entire circuit is energized from the cooking oven power source, indicated by power source 100 for convenience.

The digital display elements 24 of the digital display 22, keys 26, 27 and 28, and starting button 16 are connected to the input-output control circuit 56.

The decoded signals from the input-output control circuit 56 are applied to the digital display elements 24 and the signals from the keys 26, 27 and 28 are supplied to the input-output control circuit 56 to encode the signals.

Reference numeral 80 (FIG. 2) schematically designates a cooking oven provided with a magnetron 82 for heating food by microwave. There is also provided an electric heater, schematically indicated by numeral 84, at the upper portion of the oven for grilling or browning food to be cooked. A temperature sensor 86 is provided preferably near the upper wall of the oven 80 and is connected to the input-output control circuit 56 to adjust the heating condition in accordance with the oven temperature. The magnetron 82 and the electric heater 84 are connected to a power control circuit 88 which is connected to the input-output control circuit 56 to control the power applied to the magnetron 82 and/or the electric heater 84. The microcomputer 54 is conventionally programmed regarding the heating of the oven by microwave and/or electric heat under predetermined conditions of temperature, time and powder according to the cooking menu. After starting the cooking, the predetermined programmed process is carried out as in an ordinary programmed microwave oven with an electric heater such as that disclosed in U.S. Pat. No. 4,177,360 or U.S. Pat. No. 4,230,731.

The operation of the cooking apparatus will now be discussed.

At first the operator of the cooking apparatus selects a manual operation or automatic operation. When a manual operation is selected, manual selecting keys 26 are depressed to thereby set cooking conditions such as temperature, time and output power as desired. When the particular manual selecting key 26, "TIME" for example, is pushed, the central processing unit 54 records that function in the memory 64, and when a particular number is selected by use of the numerical keys 28, memory 64 records that number as the number of seconds, minutes, etc., for which that function is to be performed. The specific desired value for each of the cooking variables is set by using the variable select key 26 and the numerical keys 28. Thus, the automatic cooking circuit remains inactive, and a cooking operation according to the set cooking conditions is carried out by operating the start button 16. That operation is similar to a conventional microwave oven.

When an automatic operation is selected, the key 27, designated as "AUTO" in FIG. 2, is operated and then the cooking conditions are automatically set by the programmable computer 54. First, the key 27 is set to one of "cooking", "thawing" or "grilling" or other similar positions thereby selecting a desired cooking mode or heating mode. When, for instance, a function corresponding to "cooking" is selected, and the start button 16 is depressed, the step motor 50 by means of the rotatable member 34 in the cooking menu display device 30 rotates the group of cards 32 corresponding to the "cooking" function to the display window 18. That is, the step motor will rotate until the number of the pulses of the preset counter circuit 76 (FIG. 2) from the ROM 72 and that of the pulse generator 74 after receiving the signal from the timing signal generator 68 is coincident. Thus, the selective movement of the displaying cards 32 is effectuated, and the cooking menu display cards as shown in FIG. 3A are displayed at the cooking menu display window 18.

When, for instance, an index number "0" for cooking "fish" is selected with reference in the cooking function display card 32 of FIG. 3A, and the number "0" key 28 is operated followed by the operation of the start button 16, the step motor 50 is rotated to operate the cooking menu display device 30, and the cooking menu display card 32 showing No. "0" menu as shown in FIG. 3B is displayed at the cooking menu display window 18. When the start button 16 is again depressed, the function programmed into the microcomputer 54 operates to control the temperature of the oven 80 by the sensor 86 and to control the electric heater 84 and the magnetron 82 by the power control circuit 88 through the input-output control circuit 56, in a manner similar to a conventional microwave oven as described in U.S. Pat. Nos. 4,177,369 and 4,230,731. In the event a "thawing" or "grilling" function is selected, the programmed sequence will be caried out according to that function.

More specifically, a selected display is carried out by stopping the rotatable member 34 at the selected position. The control of the rotation of the rotatable member 34 is performed by counting the number of pulses applied to the step motor 50. That is, when the step motor 50 is rotated by operating the start button 16, the timing cam 66 or other timing means enables the sensor 68 to detect a reference position. When the number of clock pulses counted subsequent to the generation of the reference signal coincides with the digital code assigned to a cooking condition, a menu display card 32 corresponding to the cooking condition is displayed whereupon the step motor 50 stops.

Setting of cooking conditions such as temperature, time, etc. is carried out automatically as the desired menu is displayed.

It would also be within the spirit and scope of the present invention to set the cooking conditions automatically when a selecting key of the keys 26 and 28 are operated for selecting a cooking menu display card. Similarly, it is also within the scope of the present invention to start the cooking operation automatically when the cooking conditions are set.

The foregoing description of a preferred embodiment of the invention has been presented for purposes of illustration and description. It is not intended to be exhaustive or to limit the invention to the precise form disclosed, and obviously many modifications and variations are possible in light of the above teachings. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A cooking apparatus comprising:

a means for cooking items;

a panel associated with said cooking apparatus having means thereon for generating control signals;

a display means comprising a plurality of display cards, each inscribed with cooking information on a surface thereof, and a rotatable member, said display cards being swingingly secured to a peripheral portion of said rotatable member to pivot about an axis, said display cards pivoting in a direction substantially perpendicular to said surface;

drive means for rotating said rotatable member to successively pivot and display said display cards according to the position of said rotatable member;

control means for controlling said drive means to rotate to a position determined by said control signals;

means, responsive to said control signals, for automatically operating said cooking means according to said cooking information displayed on said display cards.

2. A cooking apparatus according to claim 1, wherein said cooking information includes a menu displayed by an upper display card and a lower display card.

3. A cooking apparatus according to claim 1, wherein said cooking information is displayed on a cooking menu comprising a pair of display cards disposed one above the other.

4. A cooking apparatus according to claim 1, wherein said display cards have an upper half and a lower half, each half having a first and second display surface with display information inscribed on both of said first and second surfaces whereby said upper half of said display card has its first surface visible and said lower half of said display card has its second surface visible, the second surface of said upper half being visible when said rotatable member is rotated.

5. A cooking apparatus according to claim 1, wherein said display means is operable to display said display cards in sequential groups, said groups corresponding to menus having similar cooking functions.

6. A cooking apparatus according to claim 1, wherein said means for generating control signals comprises switch means for manually setting desired cooking conditions.

7. A cooking apparatus according to claim 1, wherein said means for generating control signals further comprises a switch for selecting desired cooking functions.

8. A cooking apparatus according to claim 1, wherein said drive means comprises a step motor.

9. A cooking apparatus according to claim 1, wherein said cooking means comprises an electric heater.

10. A cooking apparatus according to claim 1, wherein said cooking means comprises a magnetron device.

11. A cooking apparatus according to claim 1, wherein said cooking means comprises an electric heater and a magnetron device.

12. A cooking apparatus according to claim 1, wherein said display means further comprises a stopper for restricting pivoting of said display cards, said stopper being operable to allow said display cards to pivot when said drive means is operated.

13. A cooking apparatus according to claim 1, wherein said display cards are arranged in groups, each group comprising an index indicating an order of menus for a cooking function sequentially followed by cards indicating said cooking information corresponding to said cooking function.

14. A cooking apparatus according to claim 13, further comprising a plurality of numbered indexes and wherein said means for generating control signals further comprises numerical keys for selecting said menu according to the number of an index indicating cooking information corresponding to a cooking function.

15. A cooking apparatus according to claim 1, wherein each of said display cards has a detent member at an edge portion thereof for swingingly securing said card on said peripheral portion of said rotatable member.

16. A cooking apparatus according to claim 15, wherein said rotatable member has a plurality of bearing holes along said peripheral portion for receiving said detent members.

17. A cooking apparatus according to claim 15, wherein said detent members are integral with said display card.

18. A cooking apparatus according to claim 1, wherein said control means comprises a step motor driving circuit and a preset counter for counting and comparing the number of pulses from said control signal generating means with a predetermined number of pulses.

19. A cooking apparatus according to claim 18, wherein said control means further comprises a timing signal generator for indicating the position of rotation of said rotatable member and for generating a start pulse for said preset counter to count a number of pulses, said preset counter being operable to generate a signal to drive said step motor through said step motor driving circuit according to the number of pulses determined by said control signal.

20. A cooking apparatus according to claim 18, wherein said control means further comprises a pulse generator for generating said predetermined number of pulses for said preset counter.

21. A cooking apparatus according to claim 20, wherein said drive means rotates in one direction.

* * * * *